US009765944B2

(12) United States Patent
Dureiko

(10) Patent No.: US 9,765,944 B2
(45) Date of Patent: Sep. 19, 2017

(54) TROFFER LUMINAIRE SYSTEM HAVING TOTAL INTERNAL REFLECTION LENS

(71) Applicant: GE Lighting Solutions, LLC, East Cleveland, OH (US)

(72) Inventor: Rick Dureiko, Willoughby, OH (US)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 502 days.

(21) Appl. No.: 13/710,638

(22) Filed: Dec. 11, 2012

(65) Prior Publication Data

US 2014/0160755 A1 Jun. 12, 2014

(51) Int. Cl.

| | |
|---|---|
| ***F21V 5/00*** | (2015.01) |
| ***F21S 4/00*** | (2006.01) |
| ***F21V 7/00*** | (2006.01) |
| ***F21V 5/08*** | (2006.01) |
| ***F21V 14/06*** | (2006.01) |
| ***F21V 5/04*** | (2006.01) |
| ***F21S 4/28*** | (2016.01) |
| *F21S 8/04* | (2006.01) |
| *F21Y 103/10* | (2016.01) |
| *F21Y 115/10* | (2016.01) |
| *F21Y 113/13* | (2016.01) |
| *F21Y 113/17* | (2016.01) |

(52) U.S. Cl.

CPC ..... *F21V 7/0091* (2013.01); *F21S 4/28* (2016.01); *F21V 5/043* (2013.01); *F21V 5/08* (2013.01); *F21V 14/06* (2013.01); *F21S 8/04* (2013.01); *F21Y 2103/10* (2016.08); *F21Y 2113/13* (2016.08); *F21Y 2113/17* (2016.08); *F21Y 2115/10* (2016.08)

(58) Field of Classification Search

CPC .... F21Y 2103/003; F21S 4/008; F21V 5/043; F21V 7/005; F21V 7/0091; F21V 7/043

See application file for complete search history.

(56) References Cited

U.S. PATENT DOCUMENTS

| | | | | |
|---|---|---|---|---|
| 2,356,654 | A * | 8/1944 | Cullman | 362/223 |
| 3,763,369 | A | 10/1973 | Lewin | |
| 4,734,836 | A * | 3/1988 | Negishi | 362/311.06 |
| 4,992,704 | A * | 2/1991 | Stinson | H05B 33/0821 313/303 |

(Continued)

FOREIGN PATENT DOCUMENTS

| | | | |
|---|---|---|---|
| DE | 202012103474 | U1 | 10/2012 |
| EP | 2211089 | A1 | 7/2010 |
| JP | 2012113902 | A | 6/2012 |

OTHER PUBLICATIONS

PCT Search Report and Written Opinion dated Feb. 13, 2014 from corresponding WO Application No. PCT/US2013/067984.

(Continued)

*Primary Examiner* — Ismael Negron

(74) *Attorney, Agent, or Firm* — GE Global Patent Operation; Peter T. DiMauro

(57) ABSTRACT

A troffer luminaire that includes a plurality of solid state lighting devices, and a first lens and a second lens having total internal reflection (TIR) to collect light from the lighting devices and produce a light output with good luminance uniformity; and to control the distribution profile of the light output through the first lens and the second lens as desired for particular lighting applications.

14 Claims, 9 Drawing Sheets

(56) References Cited

U.S. PATENT DOCUMENTS 5,526,190 A * 6/1996 Hubble et al. ..... 359/719
5,795,057 A 8/1998 Weigert
6,543,912 B1 4/2003 Simon
6,739,734 B1 * 5/2004 Hulgan ..... 362/243
6,964,489 B2 * 11/2005 Blume ..... G02B 27/01 349/61
7,052,152 B2 * 5/2006 Harbers ..... G02F 1/133603 349/71
7,072,096 B2 7/2006 Holman et al.
7,204,604 B2 * 4/2007 Chou ..... F21K 9/00 362/227
7,296,910 B2 11/2007 Mayfield, III et al.
7,350,955 B2 * 4/2008 Chang et al. ..... 362/612
7,455,422 B2 11/2008 Gould et al.
7,635,198 B2 12/2009 Mayfield, III et al.
7,708,428 B2 * 5/2010 Park ..... G02F 1/133611 362/231
7,794,114 B2 * 9/2010 Medendorp, Jr. ..... 362/294
7,883,232 B2 * 2/2011 Bang ..... G02F 1/133603 362/240
7,901,100 B2 * 3/2011 Peng ..... G02F 1/133608 362/247
8,002,421 B2 * 8/2011 Song ..... G02F 1/133603 362/225
8,038,314 B2 * 10/2011 Ladewig ..... 362/217.12
8,109,644 B2 * 2/2012 Bierhuizen ..... G02B 6/0018 362/249.02
8,246,219 B2 * 8/2012 Teng et al. ..... 362/311.03
8,967,822 B2 * 3/2015 Hong ..... G02F 1/133603 362/97.1
2006/0285311 A1 * 12/2006 Chang ..... G02F 1/133603 362/97.3
2009/0296388 A1 * 12/2009 Wu ..... G02B 6/0018 362/235
2009/0323334 A1 12/2009 Roberts et al.
2011/0170291 A1 * 7/2011 Simon ..... 362/241
2011/0255303 A1 10/2011 Nicol et al.
2012/0051041 A1 3/2012 Edmond et al.
2012/0092856 A1 4/2012 Zhang et al.
2012/0140461 A1 6/2012 Pickard
2012/0206911 A1 * 8/2012 Pickard ..... F21S 8/026 362/231

OTHER PUBLICATIONS

ERCO, LED Optical Systems for optimal lighting quality, 1997-2012.

"Plexiglass—Acrylic Profiles & shapes", ePlastics, http://www.eplastics.com/PlasticiPlexiglass_Acrylic_Profiles, pp. 3, Retrieved on Mar. 10, 2016.

* cited by examiner

TROFFER LUMINAIRE SYSTEM HAVING TOTAL INTERNAL REFLECTION LENS

I. FIELD OF THE INVENTION

The present invention relates generally to illumination systems. More particularly, the present invention relates to an illumination system including total internal reflection lenses.

II. BACKGROUND OF THE INVENTION

Illumination systems are an important aspect of industrial, residential, commercial, and architectural design and cover a wide variety of cost and technical considerations. Most conventional illumination systems are considered to be either direct, indirect, or direct-indirect illumination.

In the case of direct illumination systems, the illumination source (e.g., downlights) is often visible, which often presents disadvantages such as significant amounts of glare, high surface brightness, and the like. To mitigate these disadvantages, shielding elements such as baffles or lenses are typically used to cover or substantially surround the lighting source, e.g., a fluorescent lamp. However, shielding elements do not completely eliminate these disadvantages. Shielding elements also fail to produce optimal optical efficiency, particularly in areas where the surfaces of the lamps are not directly viewed.

Indirect illumination systems are typically used to mitigate many of the disadvantages associated with direct illumination, a few of which were noted above. In indirect illumination systems, the illumination source (e.g., uplights) is mounted below a troffer such that light is reflected (indirectly) towards an area to be illuminated. While indirect illumination systems avoid some of the disadvantages associated with direct illumination systems, they introduce a substantial loss in the luminous flux or lumens reflected, and are therefore significantly less efficient than direct illumination systems.

In direct-indirect illumination systems, both direct illumination lamps and indirect illumination lamps are used. While the direct-indirect illumination systems offer some improvements in transmitted lumens when compared to indirect illumination systems, they still introduce many of the disadvantages associated with direct illumination systems.

Other conventional illumination systems, such as parabolic and prismatic troffers, also have shortcomings. For example, parabolic and prismatic troffers often introduce distractions related to inconsistent brightness and lighting patterns, particularly to moving observers. Additionally, prismatic troffers often suffer from reduced lighting efficiency and the "cave effect", where the upper walls of the illuminated area are dark.

Lighting system efficiencies are an important consideration during the lighting system design process. During design, the choice of a particular illumination source will depend largely on the design objectives, the technical requirements of the particular application, and economic considerations. Other design factors include illumination source distribution characteristics, lumen package, aesthetic appearance, maintenance, productivity, and the lighting source.

The lighting source can be one of the most important considerations. Known lighting sources include, for example, incandescent bulbs, fluorescent bulbs or lamps, and more recently solid state lighting sources, such as light emitting diodes (LEDs).

Incandescent bulbs, however, are notoriously energy inefficient with approximately ninety percent (90%) of the electricity consumed by the bulb being released as heat rather than light. Fluorescent lamps are substantially more energy efficient (by a factor of about ten) than incandescent bulbs. Therefore, fluorescent lamps are most often the preference of lighting system designers, particularly for industrial and commercial applications. LEDs, however, are even more energy efficient than fluorescent lamps—emitting the same lumens as incandescent bulbs and fluorescent lamps using a fraction of the energy.

In addition to being more energy efficient, LEDs also provide a substantially longer operational life when compared to incandescent bulbs and fluorescent lamps. For example, the operational life of an LED is about 70,000 hours. By contrast, fluorescent lamps tend to last up to about 20,000 hours and incandescent bulbs are about 1000 hours. Other LED advantages include improved physical robustness, reduced size, and faster switching. Although they offer many advantages, LEDs are relatively expensive for use in lighting applications and require more current and heat management.

Although LEDs can be combined to produce mixed colors, conventional LEDs cannot produce white light from their active layers. White light can only be produced by combining other colors. Thus, the particular manner used by LEDs to produce white light can be an important factor when considering LEDs as a lighting source.

One traditional approach for configuring LEDs to produce white light is the use of multicolor light sources such as specular reflector systems. Another approach includes the use of multicolor phosphors or dyes. Each of these approaches, however, has significant deficiencies including the introduction of shadows, color separation, and/or poor color uniformity over the entire range of viewing angles. One solution to these deficiencies includes using a diffuser to scatter light from the various (i.e., multiple) sources. The use of a diffuser, however, or diffusive materials, can cause significant optical losses and can add significant expenses.

Given the aforementioned deficiencies, what is needed, therefore, is a low cost, optically efficient lighting system having desirable light distribution and luminance uniformity. What are also needed are simple, low cost systems and methods for controlling the light output distribution of a lighting source with minimal optical losses.

III. SUMMARY OF THE EMBODIMENTS OF INVENTION

Embodiments of the present invention provide a lighting system including an electrical assembly, and a plurality of solid state lighting devices interconnected within the electrical assembly, each being configured to emit a respective ray of light. Each of the devices is operatively coupled to a lens that reflects the ray of light emitted by the device. The lens may include one or more lenses each formed of a semi-cylindrical rod having high optical efficiency. In operation, the ray of light is reflected based on at least one from the group consisting of the distance of the lens from the device, the distance of a first lens from a second lens, an angle of the lens with respect to an optical axis of the device, and the distance of a surface of the device from the top of a reflector.

In the embodiments, the one or more semi-cylindrical lenses are configured to, in operation, allow substantially all of the light emitted from the linear array of light sources to pass through the lenses in a manner that controllably directs the distribution of light output by the lenses.

In at least another aspect, the embodiments provide a troffer luminaire system including a lighting source having a linear array of light emitting diodes, and a lens in optical communication with the lighting source. The lighting source is configured to emit light onto the lens. The lens provides total internal reflection and is configured to transmit substantially all of the light emitted by the lighting source. A reflector and diffuser may also be, optionally, included in optical communication with the lighting source. The reflector is configured to reflect light emitted by the lighting source. The diffuser is configured to blend light transmitted by the lens and light reflected by the reflector such that the light is blended to yield a more uniform distribution of light. In operation, the lens is configurable to controllably direct the transmission of light onto an area to be illuminated.

In yet another aspect, the embodiments provide a lighting method including providing a linear array of light emitting diodes that emit light; positioning one or more semi-cylindrical lenses having total internal reflection in optical communication with the light emitting diodes; and, optionally, adjusting the position of the one or more lenses in order to change the distribution of light output by the lenses. In operation, substantially all of the light emitted by the light emitting diodes is made to pass through the one or more semi-cylindrical lenses and is controllably directed onto an item or area to be illuminated.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

IV. BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention.

FIGS. 1A-C are illustrations of a troffer luminaire system in accordance with an embodiment of the present invention.

Figure 2A:
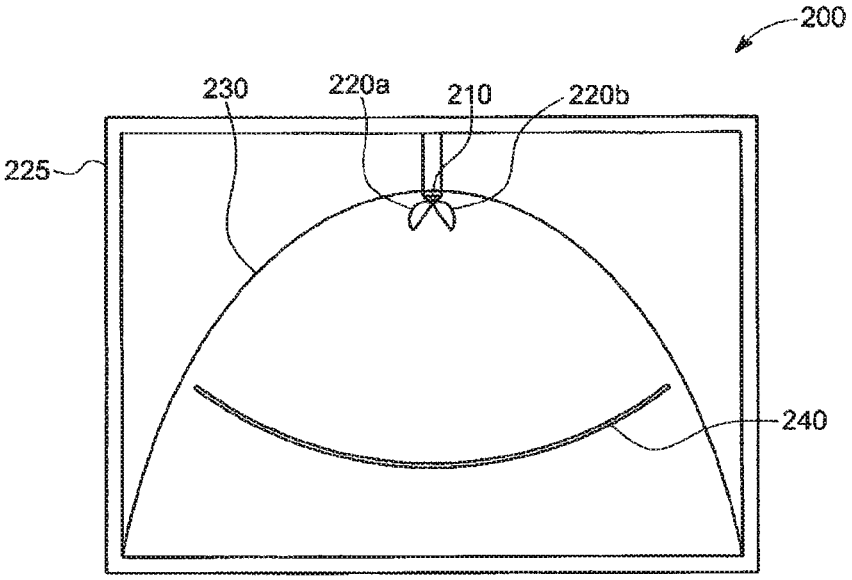
Figure 2B:
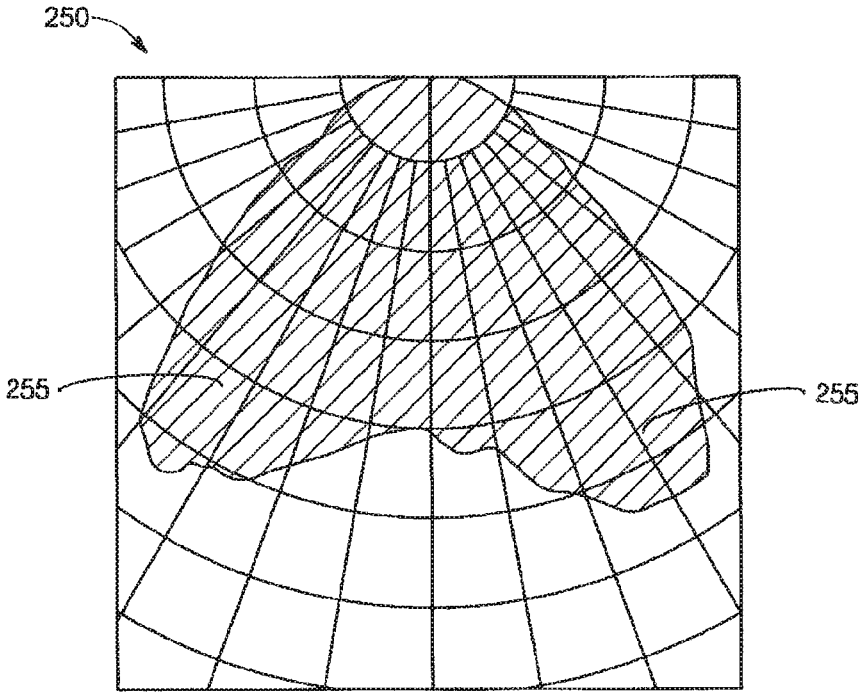

FIGS. 2A-B are illustrations of an embodiment of the troffer luminaire system of the present invention having a narrow batwing light distribution.

Figure 3A:
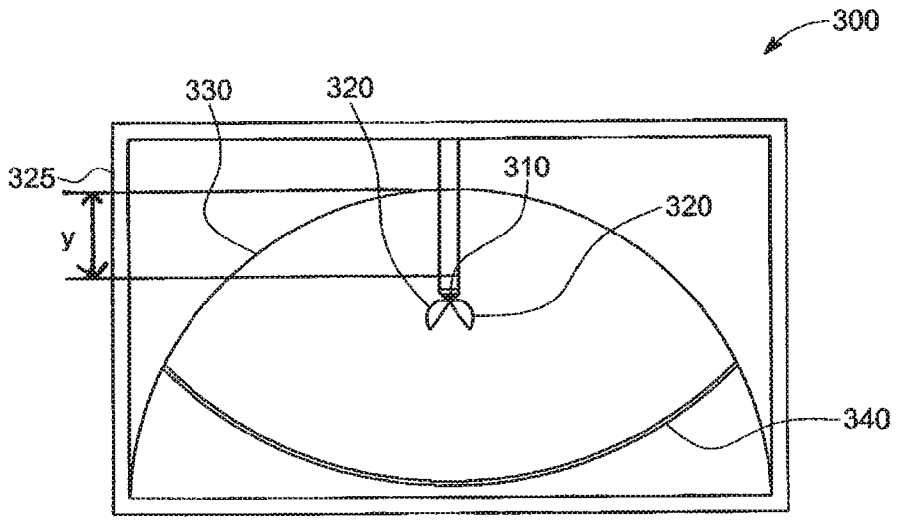
Figure 3B:
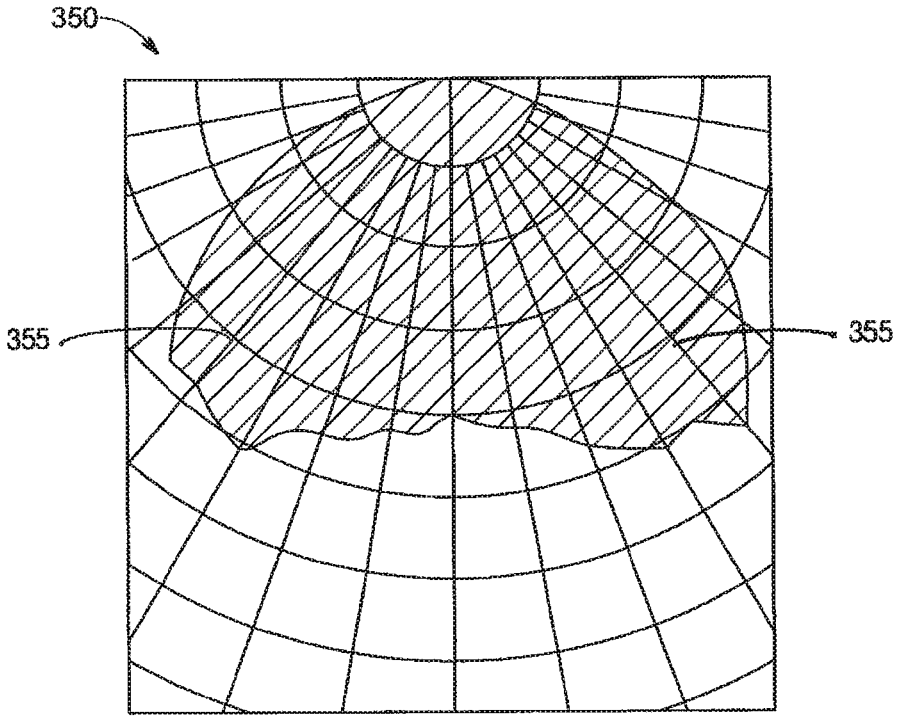

FIG. 3A-B are illustrations of the troffer luminaire system having a wide batwing light distribution in accordance with embodiments of the present invention.

FIGS. 4A-E are illustrations of alternative embodiments of the troffer luminaire system in accordance with the present invention.

Figure 5:
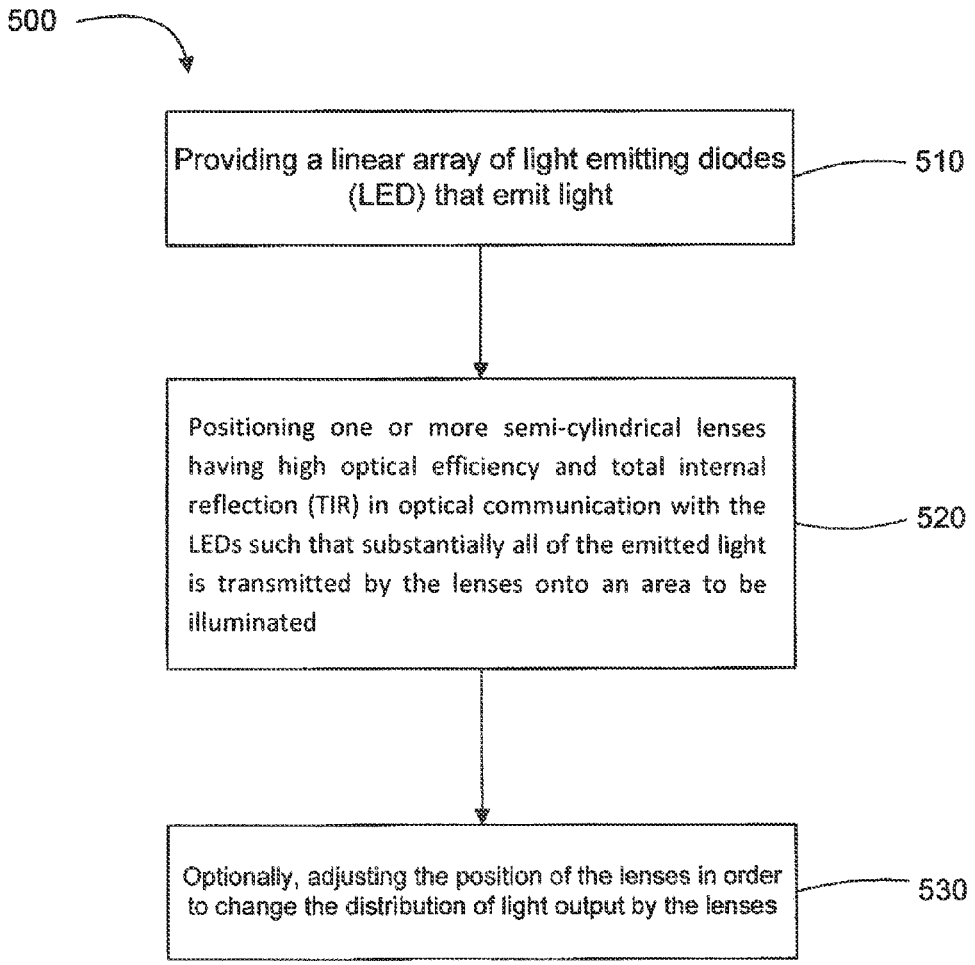

FIG. 5 is an illustration of a method for utilizing a lighting system in accordance with embodiments of the present invention.

The drawings are only for purposes of illustrating preferred embodiments and are not to be construed as limiting the disclosure. Given the following enabling description of the drawings, the novel aspects of the present disclosure should become evident to a person of ordinary skill in the art.

V. DETAILED DESCRIPTION OF EMBODIMENTS OF THE PRESENT INVENTION

The following detailed description is merely exemplary in nature and is not intended to limit the applications and uses disclosed herein. Further, there is no intent to be bound by any theory presented in the preceding background or summary, or the following detailed description. Those skilled in the art with access to the teachings provided herein will recognize additional modifications, applications, and embodiments within the scope thereof and additional fields in which the invention would be of significant utility.

While embodiments of the present invention are described herein primarily in connection with LEDs, the concepts are also applicable to other types of lighting devices including solid state lighting devices. Solid state lighting devices include, for example, LEDs, organic light emitting diodes (OLEDs), semiconductor laser diodes, and the like. Similarly, while solid state lighting devices are illustrated as examples herein, the techniques and apparatuses disclosed herein are readily applied to other types of light sources, such as incandescent, halogen, other spotlight sources, and the like.

Figure 1A:
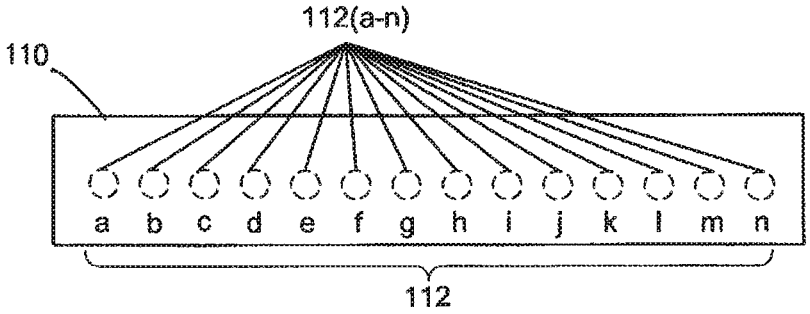
FIG. 1D is an illustration of a lens of the troffer luminaire system in accordance with an embodiment of the present invention, as shown in FIGS. 1A-C.
FIG. 1E is an exemplary illustration of a light ray tracing model for a troffer luminaire system, as shown in FIGS. 1A-C, in use.
Figure 1B:
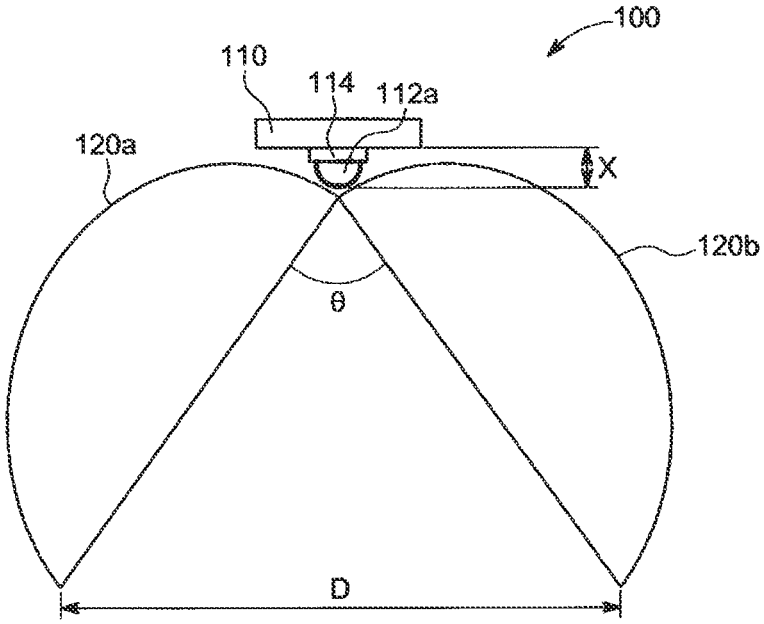

FIG. 1A is a top view illustration of a lighting strip 110 of troffer luminaire system 100 (shown in FIG. 1B). As illustrated in FIG. 1A, the elongated lighting strip 110 includes an LED array 112, including individual LEDs 112*a-n*, positioned therewithin. By way of example, LED array 112 can be mounted within the elongated lighting strip 110. In the example of FIG. 1A, the elongated lighting strip 110 is formed of a passive heat exchanger, such as a heat sink. FIG. 1B provides a more detailed illustration of one of the LEDs 112 *a-n* positioned within the elongated lighting strip 110.

Figure 1C:
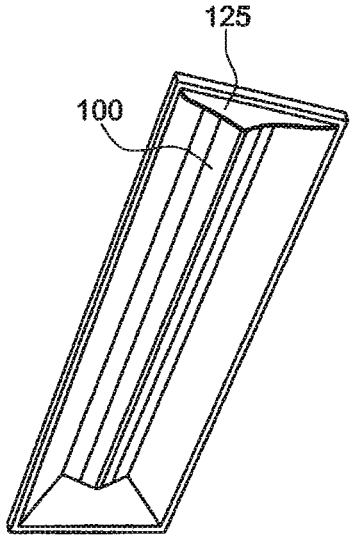

Each of the LEDs 112 *a-n* of the LED array 112, are mounted and interconnected within a printed circuit board (PCB) 114 to facilitate application of electrical power to the array. For purposes of illustration only, and not limitation, FIG. 1B provides a more detailed view of LED 112*a*. As shown in FIG. 1B, exemplary LED 112*a* of the array 112 includes one or more semi-cylindrical lenses, such as lens 120*a* and 120*b*, in optical communication with the LED 112*a*. Each of the remaining LEDs 112*b-n* of the LED array 112 are also in optical communication with lenses 120*a* and 120*b*. In FIG. 1B, the LED 112*a* and lenses 120*a/b* are mountable in a troffer 125, as illustrated in FIG. 1C.

Referring back to FIG. 1B, the PCB 114 is attached to the elongated lighting strip 110 (i.e., passive heat exchanger) such that heat produced by the elongated lighting strip 110 is dissipated into the surrounding air to cool the system 100.

The lighting strip 110 and lenses 120*a/b* form a light transmission unit configurable to transmit substantially all of the light output from the lighting strip 110 onto an area to be illuminated. Emissive faces of the LEDs 112*a-n* are preferably oriented in a direct illumination configuration, i.e. facing downward with respect to the elongated lighting strip 110. The lenses 120*a/b* are arranged in a manner (symmetric or asymmetric) such that light output from one region of the LEDs 112*a-n*, e.g., a central region, is redirected to another region, e.g., off axis. By varying one or more of: (i) the distance of the lenses 120*a/b* from the LEDs 112*a-n*, (ii) the distance of the lens 120*a* from the lens 120*b*, (iii) an angle of the lenses 120*a/b* with respect to an optical axis of the LEDs 112*a-n*, and (iv) the distance of a surface of the LED 112*a* from the top of the troffer 125, light can be distributed in an optically efficient manner with good troffer luminance uniformity.

The LEDs 112*a-n* within the LED array 112 are interconnected in groups or clusters to produce a warm white light output when properly mixed. Various known techniques may be used to produce white light. For example, the LEDs 112*a-n* may be compatible with a blue-shifted-yellow plus red (BSY+R) LED lighting technique, well known by those of skill in the art, using a combination of BSY LEDs and red LEDs (R). BSY refers to the color produced when a fraction of blue LED light is wavelength-converted by a yellow phosphor coating. The resulting light output is a yellow-green color in addition to the blue source light. BSY light and red light when properly mixed produce a warm white light. Therefore, the BSY+R LED lighting scheme would be suitable for producing a warm white light appropriate for use with the troffer luminaire system 100.

By way of further example, the LEDs 112*a-n* may also be compatible with another exemplary known technique includes using a red, green and blue (RGB) LED scheme. The RGB LED scheme may be used to generate various light colors, including white light appropriate for use with the troffer luminaire system 100. While the BSY+R and RGB lighting schemes have been discussed herein, they are provided merely as examples. Thus, it should be understood that other LED lighting schemes would be within the spirit and scope of the present invention and can be used to generate a desired output light color.

Figure 1D:
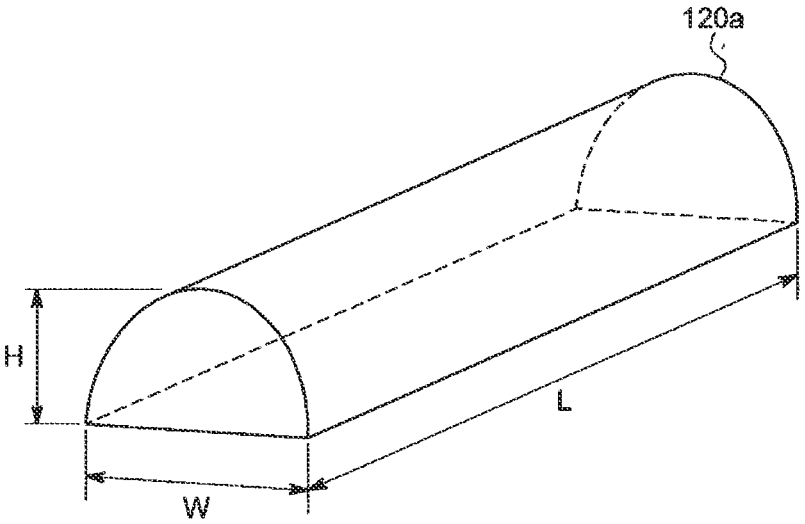

FIG. 1D is an illustration of an exemplary shape of one of the semi-cylindrical lenses, such as lens 120*a*, associated with the LEDs 112*a-n*. By way of example, the semi-cylindrical lens 120*a* is formed of a low cost, acrylic, e.g., an extruded acrylic rod having a semi-cylindrical profile. The semi-cylindrical lens 120*a* is defined by length L, width W, and height H. Various exemplary approximate dimensions of the lenses 120*a/b* are within the spirit and scope of embodiments of the present invention. These exemplary approximate dimensions are dependent upon the intended application and associated technical requirements. By way of example, typical residential and commercial applications might require lenses 120*a/b* that span a few inches to several feet in length, 0.5 inches to 3 inches in width, and 0.25 inches to 1.5 inches in height. Commercially available extruded acrylic rods suitable for use with the system of the present disclosure include, for example, ePlastics™ half round rods available from Ridout Plastics Co. Inc. of San Diego, Calif. Exemplary compatible models include ARCHALF.500, ARCHALF.625, ARCHALF.750, and ARCHALF1.000. While the troffer luminaire system 100 including the semi-cylindrical lenses 120 have been described in terms of suitable approximate dimensions, other dimensions may be used as suitable for the intended application and lighting requirements without departing from the disclosure.

As illustrated in FIG. 1B, the troffer luminaire assembly 100 includes the dimensions D, θ, x, and y (dimension y is shown in FIG. 3A). Dimension D defines the distance of separation of the lenses 120*a/b* at points on the ends of the lenses 120*a/b* having the widest separation. Dimension θ defines the angle of separation of the lenses 120*a/b*. In some embodiments, e.g., embodiments having a single lens 120*a*, θ may be defined with respect to a vertical axis or the optical axis of the LED 112*a*. Dimension x defines the distance of separation between the elongated lighting strip 110 and the lenses 120*a/b*. Dimension y defines the distance of separation between the elongated lighting strip 110 and the top of a troffer reflector (not shown here).

Dimensions D, θ, and x, along with y define the light distribution of the assembly 100. As D and θ increase, the distribution of light spreads further away, i.e., over a wider area. As D and θ decrease, the distribution of light focuses over a more narrow area. As x increases, the amount of light from the LEDs 112*a-n* that is coupled into the lenses 120*a/b* decreases, i.e., a smaller fraction of the angular distribution of the light is influenced by the lenses 120 *a/b*). This decrease in the fraction of light coupled into the lenses 120*a/b* effects the luminaire light output distribution. It follows, as x decreases, the amount of light from LEDs 112*a-n* that is coupled into the lenses 120*a/b* increases and a larger fraction of the angular distribution of the light is influenced by the lenses 120 *a/b*. In at least some embodiments, as y increases, more light is reflected by reflector (not shown). An exemplary preferred distance x for optimal efficiency is approximately 1 inch or less. It is noted that the top of the lenses 120*a/b* adjacent the elongated lighting strip 110 are positioned closely together, e.g., less than approximately 0.5 inches apart, but do not touch in order to help with heat dissipation.

Further, the individual LEDs 112*a-n* should not be visible when viewed from directly below the system 100, i.e., the system 100 should have exceptional Nadir luminance. At a distance of approximately 0.5 inches of separation between the top of the lenses 120*a/b* and an x value of approximately 1 inch or less, substantially all the light emitted by the elongated lighting strip 110, i.e., 85% to 95% or more, is totally internally reflected through the lenses 120*a/b*. It is noted that while a symmetric separation of lenses 120*a/b* is shown, other embodiments are envisioned that include asymmetric separation of lenses 120*a/b*, asymmetric positioning of lenses 120*a/b*, i.e., an asymmetric angle with respect to a vertical axis, and/or an asymmetric number of lenses 120*a/b* without departing from the disclosure. Further, multiple lenses 120 may also be used to flexibly and predictably control the distribution of light without departing from the disclosure.

Figure 1E:
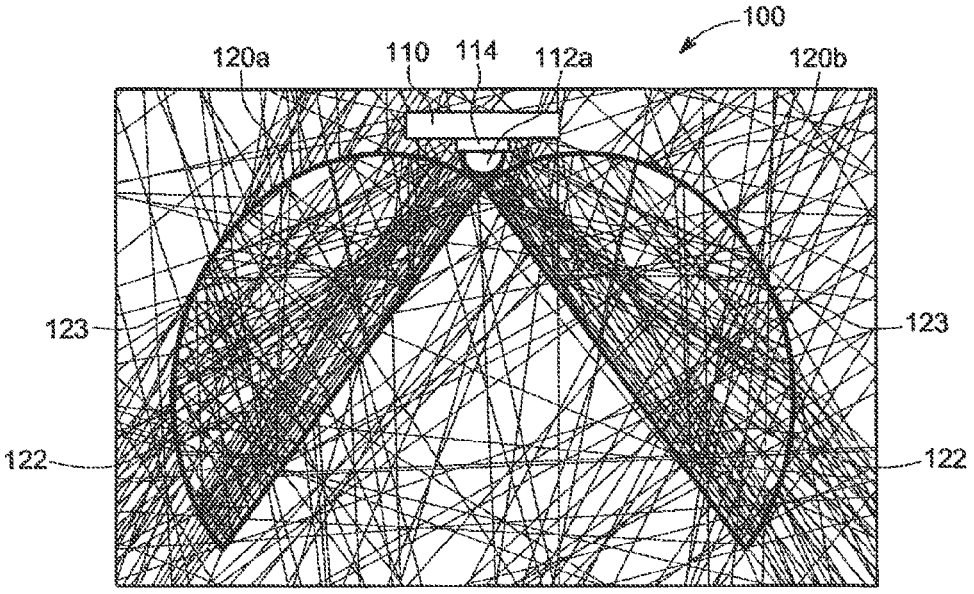

As illustrated in the ray tracing model of FIG. 1E, the high optical efficiency lenses 120*a/b* allow substantially all the light 123 output by the LEDs 112*a-n* to be transmitted through the lenses 120*a/b*. The lenses 120*a/b*, have a semi-cylindrical shape and produce the optical phenomenon of total internal reflection (TIR) when positioned adjacent the LEDs 112-*n*. Because the acrylic of the lenses 120*a/b* has a higher refractive index than the adjacent medium, i.e., the refractive index of the acrylic is higher than the refractive index of the adjacent air, TIR occurs and causes substantially all of the rays of light 123 output by the LEDs 112*a-n* to be reflected back (internally) within the medium, i.e., within the lenses 120*a/b*. This phenomenon causes substantially all the rays of light 123 to travel along the boundary layer 122 between the lenses 120*a/b* and the adjacent air and allows the rays of light 123 to be flexibly directed based on the configuration of the lenses 120*a/b* as discussed above. The outer surface 124 of the lenses 120*a/b* may also be roughed to create a spatial diffusion layer that causes the rays of light 123 to reflect thereby encouraging more blending or mixing of the rays of light 123. The increased blending of light produces a more balanced and visually pleasing light having higher uniformity and less glare.

The components of the troffer luminaire system 100 may be flexibly arranged in a variety of configurations in order to produce numerous desired light distribution profiles. FIGS. 2A-4E, discussed below, illustrate examples of embodiments of the troffer luminaire system 100 including associated light distribution profiles. The light distribution profiles provide various data related to the light output including the polar candela diagram, the light measurement data, and the Nadir luminance profile for each embodiment. The light distribution profiles provide a comprehensive profile of the light output each embodiment and may be used by lighting designers to configure the troffer luminaire systems in order to achieve a desired light distribution.

The polar candela diagram, e.g., diagram 250, graphically illustrates the output light intensity at specific directions with respect to Nadir, i.e., straight down. Intensity is on the vertical axis (downward) and radial lines indicate elevation angles in 10 degree increments. The luminous intensity, measured in candela (cd), indicates the amount of light produced in a specific direction. The luminous intensity is graphically compiled into polar formatted charts that indicate the intensity of light at each angle away from 0 degree lamp axis or Nadir.

The light measurement data, shown, for example, in Tables 1 and 2 below, lists various measurements related to the output light. These measurements include, for example, measured flux, light output ratio of luminaire (LORL), downward flux fraction (DFF), lamp factor, and the like. The measured flux or luminous flux, measured in lumens (lm), indicates the total amount of light produced by a source without regard to direction. The LORL provides an indication of the loss of light energy, both inside and by transmission through light fittings. As loss of light energy decreases, the LORL increases. Higher LORL indicate more efficient systems. LORLs in the range of 80% to 85% are considered optically efficient. LORLs above 85% are considered highly optically efficient. The DFF indicates the percentage of light that is directed down versus up. The lamp factor provides photometric information related to a particular fixture.

Illuminance, measured in lux (1×), provides the measure of the quantity of light that arrives at a surface. Three factors that affect illuminance include the intensity of the luminaire in the direction of the surface, the distance from the luminaire to the surface, and the angle of incidence of the arriving light. Although illuminance cannot be detected by the human eye, it is a common criterion used in specifying designs. Luminance, measured in candelas per square meter (cd/m2), indicates the quantity of light that leaves a surface and is what the human eye perceives. Luminance indicates more about the quality and comfort of a design than illuminance alone. The cutoff angle of a luminaire indicates the angle between the vertical axis (or Nadir) and the line of sight when the brightness of the source or its reflected image is no longer visible. The cutoff angle is the controlling factor for visual comfort in a lighting system.

The Nadir luminance indicates the quality and uniformity of the output light when viewed from directly below the lighting source. Preferred Nadir luminance is comfortable and pleasing to the eye, and shows no individual LEDs or unblended light.

FIGS. 2A-B are illustrations of an embodiment of the troffer luminaire system 300 of the present invention having a narrow batwing light distribution. As illustrated in FIG. 2A, the luminaire system 200 includes an elongated lighting strip 210 having an LED array including individual LEDs, lenses 220*a/b*, reflector 230, and diffuser 240. The luminaire system 200 may be mounted in a troffer 225. The elongated lighting strip 210 and individual LEDs are mounted in close proximity to both the lenses 220*a/b* and the reflector 230. The reflector 230 causes lost or scattered light to be reflected and mixed with other rays of light before being output. The diffuser 240 may be, for example, a light shaping diffuser, e.g., a 20 degree full width half maximum (FWHM) diffuser. The diffuser 240 is substantially spaced apart from the LED assembly 210 and causes rays of light passing therethrough to be blended thereby producing a light output having good uniformity.

As illustrated in FIG. 2B, the luminaire system 200 produces a polar candela light diagram 250 having a narrow batwing light distribution. The candela light diagram 250 indicates more intense light being distributed on a narrowly spaced light distribution area 255.

Table 1 below illustrates exemplary light measurement data of the luminaire system 200. The light measurement data shows a LORL of greater than 89% which indicates high optical efficiency, and a DFF of greater than 99%. The Nadir luminance of the luminaire system 200 has exceptional quality and uniformity of the output light.

TABLE 1

| | |
|---|---|
| Measured flux: | 3737.7 1 m |
| Light output ratio luminaire (LORL): | 89.42% |
| Downward flux fraction (OFF): | 99.92% |
| UTE C71 - 121 photometric: | 0.89 F |

FIGS. 3A-B are illustrations of an embodiment of the troffer luminaire system of the present invention having a wide batwing light distribution. As illustrated in FIG. 3A, the luminaire system 300 includes an elongated lighting strip 310 having an LED array including individual LEDs, lenses 320*a/b*, reflector 330, and diffuser 340. The luminaire system 300 may be mounted in a troffer 325. The elongated lighting strip 310 and individual LEDs are mounted in close proximity to the lenses 320*a/b*. However, the elongated lighting strip 310 and lenses 320*a/b* are mounted substantially spaced apart from both the reflector 330 and the diffuser 340. The luminaire system 300 produces a polar candela light diagram 350 having a wide batwing light distribution, indicating light of substantially even intensity being distributed over a wide light distribution area 355. Table 2 below illustrates exemplary light measurement data of the luminaire system 300. The light measurement data shows a LORL of greater than 92% which indicates high optical efficiency, and a DFF of greater than 99%. The Nadir luminance of the luminaire system 300 has exceptional quality and uniformity of the light output.

TABLE 2

| | |
|---|---|
| Measured flux: | 3849.74 1 m |
| Light output ratio luminaire (LORL): | 92.1% |
| Downward flux fraction (OFF): | 99.95% |
| UTE C71 - 121 photometric: | 0.92 E |

Figure 4A:
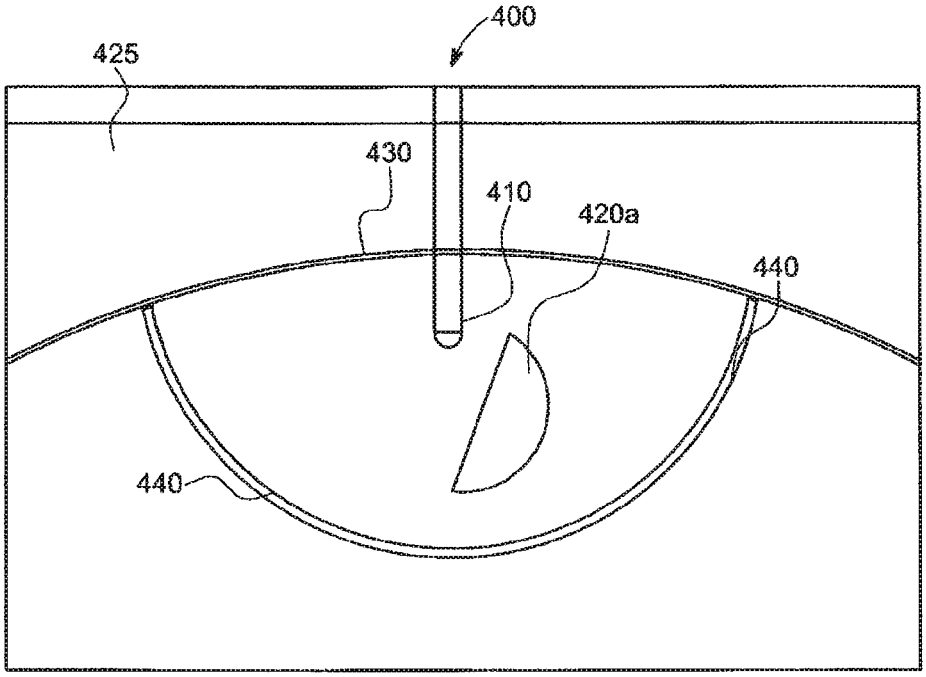

FIG. 4A-E are illustrations of alternative embodiments of the troffer luminaire system of the present invention. The alternative embodiment according to FIG. 4A illustrates a single, offset lens and closely spaced, parabolic diffuser that produce an asymmetric-batwing light distribution. As shown in FIG. 4A, the luminaire system 400 includes an elongated lighting strip 410 having an array of LEDs, a single offset lens 420*a*, a reflector 430, and a parabolic diffuser 440. The luminaire system 400 may be mounted in a troffer 425. The single, offset lens 420*a* is positioned such that the flat surface is exposed to the array of LEDs and is at approximately a 30 degree angle relative to vertical. The elongated lighting strip 410 is mounted slightly spaced from both the single, offset lens 420*a* and the reflector 430. The parabolic diffuser 440 is in close proximity to the single, offset lens 420*a*, and surrounds both the offset lens 420*a* and the elongated lighting strip 410.

Figure 4B:
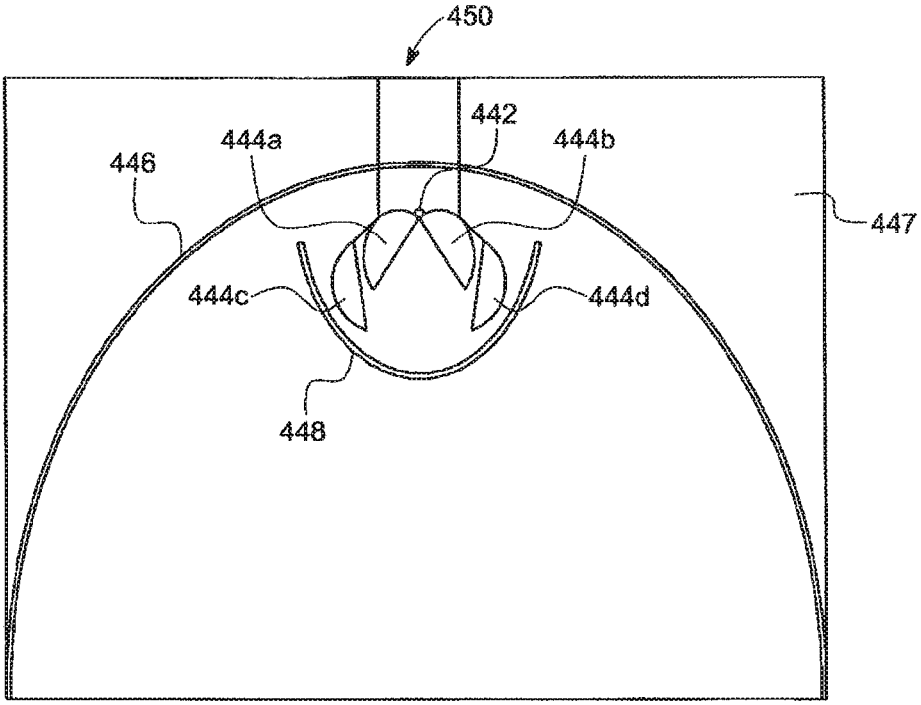

The alternative embodiment according to FIG. 4B illustrates the troffer luminaire system 470 of the present invention having multiple lenses and a closely spaced diffuser that produce a narrow, flat bottom light distribution. As shown in FIG. 4B, the luminaire system 450 includes an elongated lighting strip 442, lenses 444*a-d* reflector 446, and parabolic diffuser 448. The elongated lighting strip 442 is mounted within a troffer 447 in close proximity to lenses 444*a/b*. Lenses 444*c-d* are placed on either outer perimeter of lenses 444*a-b* such that any light that passes through lenses 444*a-b* is "clamped" and passed to parabolic diffuser 448. Each of lenses 444*a-b* is in close proximity to one of lenses 444*c-d*. Lenses 444*c-d* are in close proximity to the parabolic diffuser 448 which substantially surrounds all lenses 444*a-d*.

Figure 4C:
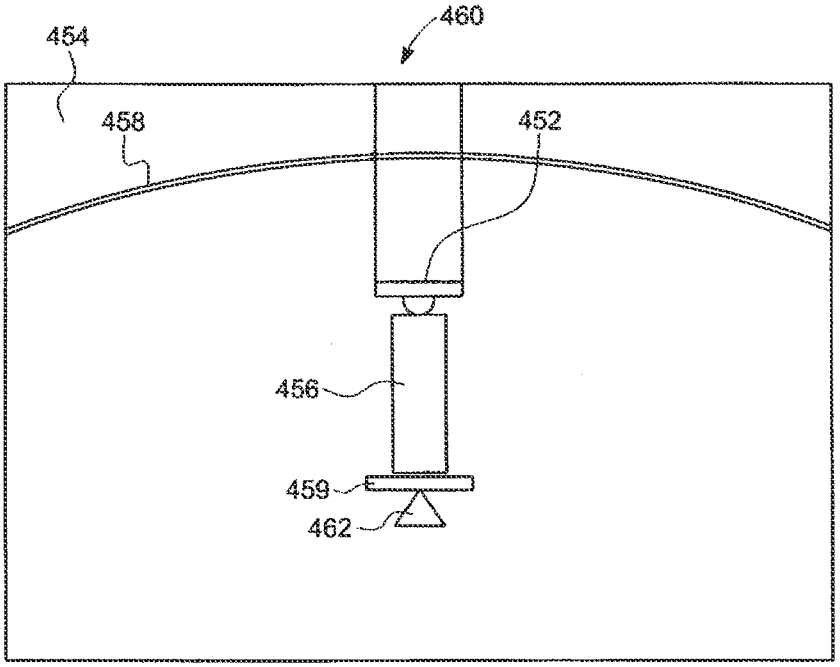

The alternative embodiment according to FIG. 4C illustrates the troffer luminaire system of the present invention having a guide and a diffuser that produces a middle void light distribution. The troffer luminaire system 460, as shown in FIG. 4C, utilizes both refraction and reflection to transmit and direct the distribution of light output by the LEDs of the elongated lighting strip 452. The system includes a light guide 456, a light diffuser 459, and an optical prism 462. The system also includes a reflector 458. The elongated lighting strip 452 and/or other lighting components including the light guide 456, diffuser 459, and optical prism 462 may form a light transmission unit that may be mounted within a troffer 454. The diffuser 459 and optical prism 462 form a prismatic diffuser that diffuses and spreads the light output by the LEDs of the elongated lighting strip 452. The light guide 456 and optical prism 462 are arranged such that light output from the lighting strip 452 is transmitted through the optical prism 462 and onto an area to be illuminated. The acrylic guide 456 may be formed of the same material as the lenses 420*a/b*, discussed with respect to FIG. 1. However, the guide 456 embodies a substantially elongated shape and is positioned substantially parallel to the LEDs of the elongated lighting strip 452 such that light is refracted and guided along the length of the guide 456. An end of the acrylic guide 456 is positioned adjacent the LEDs of the elongated lighting strip 452 such that substantially all of the light output by the LEDs is collected by and transmitted within the guide 456. A diffuser 459 is positioned adjacent the opposite end of the guide 456 such that the focused light emitted from the guide 456 is spread over a larger area. The diffuser 459 causes the rays of light to bounce and mix such that the light is blended. The optical prism 462, formed of optical grade acrylic or glass, reflects the diffused light through the sides of the optical prism 462, i.e., to the left and right of the prism 462, such that light is selectively directed over a wide area.

Figure 4D:
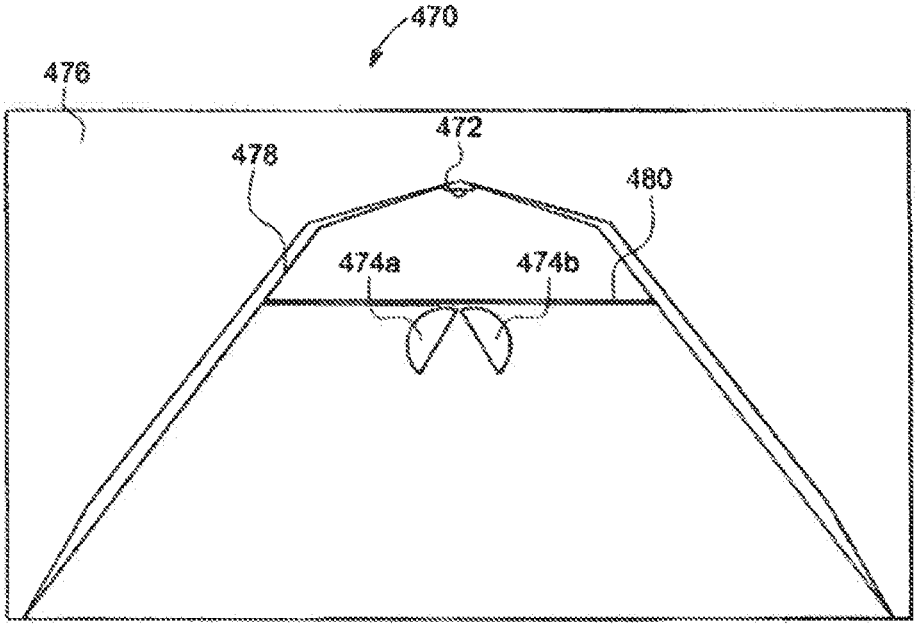

The alternative embodiment according to FIG. 4D illustrates the troffer luminaire system 470 of the present invention include a reflector and diffuser that produces a slight batwing light distribution. As shown in FIG. 4D, the luminaire system 470 includes an elongated lighting strip 472 having an array of LEDs, lenses 474*a/b*, reflector 478, and a diffuser 480. The diffuser 480 may be, for example, a light shaping diffuser, e.g., a 20 degree full width half maximum (FWHM) diffuser. The elongated lighting strip 472 and/or lenses 474*a/b* may be mounted to troffer 476 and/or diffuser 480. The elongated lighting strip 472 is mounted in close proximity to the reflector 478. The FWHM diffuser 480 is mounted on the reflector 478 between the array of LEDs of the elongated lighting strip 472 and lenses 474*a/b*. The lenses 474*a/b* are in close proximity to the FWHM diffuser 480. At least some of the light emitted from the LEDs is reflected by the reflector 478 before passing through the FWHM diffuser 480 which blends and shapes the light. The light then passes through the lenses 474*a/b* and is directed to an area to be illuminated.

Figure 4E:
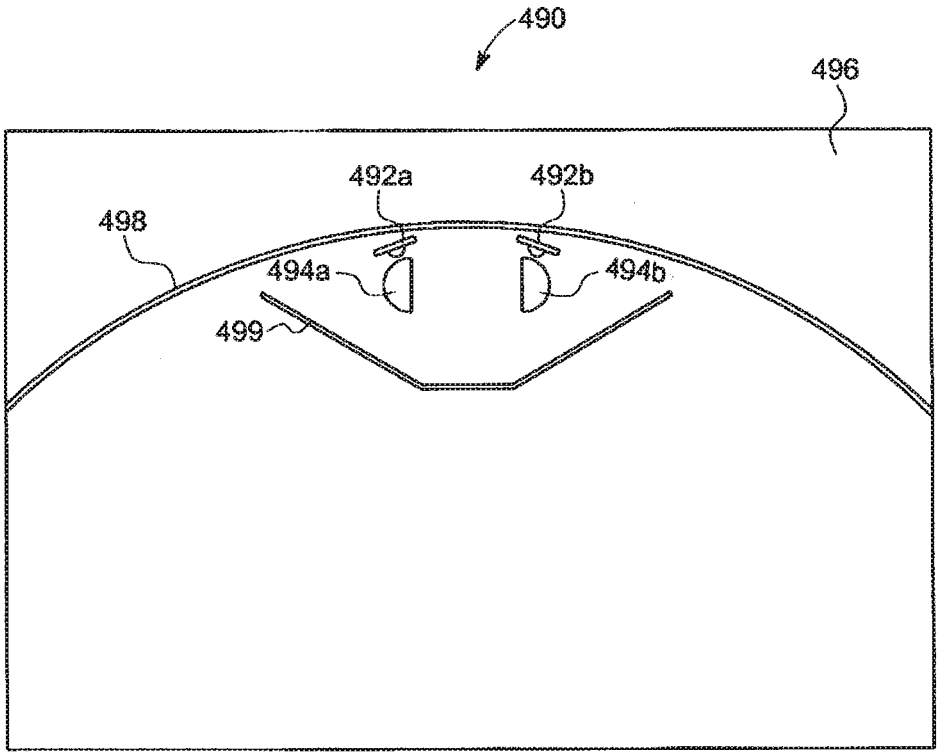

The alternative embodiment according to FIG. 4E illustrates the troffer luminaire system of the present invention including a dual, spaced LED-lens configuration and a spaced angular diffuser that produces a substantially narrow and even light distribution. As shown in FIG. 4E, the luminaire system 490 includes elongated lighting strips 492*a/b* each having arrays of LEDs, lenses 494*a/b*, reflector 498 and angular FWHM diffuser 499. The elongated lighting assemblies 492*a/b* are spaced apart from each other and are each in close proximity to the reflector 498. The LEDs of the elongated lighting strips 492*a/b* are in close proximity with a single lens 494*a* and 494*b*, respectively. The elongated lighting strips and/or lenses 494*a/b* may be mounted within a troffer 496 and in close proximity to the reflector 498. The lenses 494*a/b* are in close proximity to the FWHM diffuser 499. At least some of the light emitted from the LEDs is reflected by the reflector 498 before passing through the FWHM diffuser 499 which blends and shapes the light. The light then passes through the lenses 494*a/b* before being directed to an area to be illuminated.

The various embodiments of the troffer luminaire system, as discussed above with respect to FIGS. 1A-4E, may be selectively utilized to controllably direct the distribution of light onto an item or area to be illuminated. Each of the embodiments provides a unique configuration of the lighting system including one or more lenses and one or more light sources (or lighting assemblies) that controllably directs substantially all the light collected from the light sources onto an item or area. The lighting system is configurable to direct the light such that the distribution profile of the light output is substantially controlled.

FIG. 5 provides a method for utilizing a lighting system in accordance with an embodiment of the present invention. The method 500 provides an overview for utilizing the lighting system disclosed herein to controllably direct the distribution of light to illuminate an item or area. As discussed above, each of the embodiments of the lighting system provides a substantially unique lighting profile that may be selectively utilized based on the lighting profile provided. Also, each of the embodiments of the lighting system may also be adjusted to further control and direct the distribution of light. FIG. 5 discloses a method for controllably directing light utilizing the system disclosed herein. At 510, the method begins by providing a substantially linear array of light emitting diodes (LEDs), wherein the LEDs emit light. At 520, the one or more lenses are positioned in optical communication with the LEDs. The lenses are positioned so that substantially all of the light emitted from the LEDs is directed onto an item or area to be illuminated. At 530, the position of the lenses may be, optionally, adjusted in order to change the distribution of light output by the lenses. At 520 and 530, respectively, the lenses are positioned and adjusted based on the parameters D, θ, x, and y, as discussed with respect to FIGS. 1A-E. The positioning and adjustment of the lenses allows for substantially all of the light emitted from the LEDs to be flexibly transmitted through the lenses to control of the distribution of light over a wide range of light distribution profiles, as outlined with respect to FIGS. 2A-4E.

Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

I claim:

1. A lighting system comprising:

a lighting strip including a plurality of light sources;

a first lens and a second lens each being in optical communication with the plurality of light sources such that substantially all of the light emitted by the plurality of light sources is transmitted through the first and second lenses;

wherein the first and second lenses are disposed adjacent to the lighting strip at a position characterized by (i) a top of the first lens and a top of the second lens not touching one another and by (ii) the top of the first lens and the top of the second lens each having a distance of separation relative to the lighting strip; and wherein the top of the first lens and the top of the second lens are disposed less than about 0.5 inch apart.

2. The lighting system according to claim 1, wherein the lighting system further includes a troffer housing the plurality of light sources.

3. The lighting system according to claim 1, further comprising a reflector being in optical communication with the plurality of light sources.

4. The lighting system according to claim 1, further comprising a diffuser being in optical communication with the plurality of light sources.

5. The lighting system according to claim 4, wherein the diffuser is a light shaping diffuser.

6. The lighting system according to claim 1, wherein the first lens and the second lens each include a semi-cylindrical lens.

7. The lighting system according to claim 1, wherein the first lens and second lens are formed of an acrylic rod.

8. A troffer luminaire system, comprising:

a plurality of light emitting diodes; and a first lens and a second, each being in optical communication with the plurality of light emitting diodes, wherein the first lens and the second lens are disposed adjacent to the plurality of light emitting diodes in a position providing total internal reflection such that substantially all of the light emitted by the plurality of light emitting diodes is transmitted through the first and second lenses;

wherein the position is characterized by (i) a top of the first lens and a top of the second lens not touching one another and by (ii) the top of the first lens and the top of the second lens each having a distance of separation from the plurality of light emitting diodes; and wherein the top of the first lens and the top of the second lens are disposed less than about 0.5 inch apart.

9. The troffer luminaire system according to claim 8, wherein the position is further characterized by the first and second lenses being disposed at an angle with respect to one another.

10. The troffer luminaire system according to claim 8, further comprising a reflector in optical communication with the plurality of light emitting diodes.

11. The troffer luminaire system according to claim 10, further comprising a diffuser in optical communication with the plurality of light emitting diodes.

12. A lighting method, comprising:

mounting a linear array of light sources in a fixture housing for emitting light;

disposing a first lens and a second lens operatively coupled to at least one light source of the light sources and being semi-cylindrical and having total internal reflection in optical communication with the light sources such that substantially all of the light emitted by the light sources is transmitted through the first lens and the second lens and onto an item or area to be illuminated; and adjusting a position of the first lens and the second lens to direct transmission of light to be reflected internally, and change the distribution of light output by the first lens and the second lens.

13. The lighting method according to claim 12, wherein the light is transmitted through the first lens and the second lens are based on at least one from the group consisting of the distance of the first lens or the second lens from the lighting source, the distance of the first lens from the second lens, an angle of the first lens or the second lens with respect to an optical axis of the lighting source, and the distance of a surface of the lighting source from the top of the fixture housing.

14. The lighting method according to claim 12, wherein the light sources are light emitting diodes.

* * * * *